US007338341B2

(12) United States Patent
Hoeting et al.

(10) Patent No.: US 7,338,341 B2
(45) Date of Patent: Mar. 4, 2008

(54) DANCING TOY

(75) Inventors: Michael G. Hoeting, Cincinnati, OH (US); Steven K. Hurt, Aurora, IN (US); Steven T. Fink, Cincinnati, OH (US)

(73) Assignee: Bang Zoom Design Ltd., LLC, Cincinnati, OH (US)

( * ) Notice: Subject to any disclaimer, the term of this patent is extended or adjusted under 35 U.S.C. 154(b) by 192 days.

(21) Appl. No.: 10/976,939

(22) Filed: Oct. 29, 2004

(65) Prior Publication Data

US 2005/0118927 A1 Jun. 2, 2005

Related U.S. Application Data

(60) Provisional application No. 60/516,528, filed on Oct. 31, 2003.

(51) Int. Cl.
*A63H 3/20* (2006.01)

(52) U.S. Cl. ..... 446/330; 446/355; 446/297; 446/268

(58) Field of Classification Search ..... 446/330, 446/297, 268, 351–356, 175, 358; 74/25, 74/54, 60, 416, 417
See application file for complete search history.

(56) References Cited

U.S. PATENT DOCUMENTS 1,430,811 A * 10/1922 Johnson et al. ..... 40/456
1,661,093 A * 2/1928 Rogers ..... 446/354
1,685,358 A * 9/1928 Harcourt ..... 40/416
2,637,936 A * 5/1953 Dale et al. ..... 446/236
2,960,796 A * 11/1960 Woodrey ..... 446/358
3,243,916 A * 4/1966 Ryan ..... 446/355
3,509,661 A * 5/1970 Ach ..... 446/316
3,609,909 A * 10/1971 Gardel et al. ..... 446/355
3,964,205 A * 6/1976 Kuramochi ..... 446/338
4,217,726 A * 8/1980 Flicker et al. ..... 446/361
4,545,775 A * 10/1985 Kim ..... 446/299
4,869,703 A * 9/1989 Ong S.T. ..... 446/353
5,176,560 A 1/1993 Wetherell et al.
5,413,517 A 5/1995 Kamijima
5,820,441 A * 10/1998 Pracas ..... 446/354
5,823,845 A * 10/1998 O'Berrigan ..... 446/234
6,500,043 B1 12/2002 Fong
6,579,143 B1 6/2003 Rehkemper et al.
2003/0129922 A1* 7/2003 Curran et al. ..... 446/484

FOREIGN PATENT DOCUMENTS

JP 2002282559 A * 10/2002

OTHER PUBLICATIONS http://www.2xlrobot.com/robots/kasey.html, You have selected C: Kasey the Kinderbot, Jan. 7, 2005, pp. 1-5.

* cited by examiner

*Primary Examiner*—Eugene Kim
*Assistant Examiner*—Urszula M Cegielnik
(74) *Attorney, Agent, or Firm*—Frost Brown Todd LLC

(57) ABSTRACT

An animated toy effectively mimics human dance steps such as the Hokey Pokey with upper and lower halves of the torso pivoting about a diagonal waist laterally upwardly sloping to the left so that a left arm may be put forward and back. A spin/shake drive mechanism in a left leg selectively rotates the toy about a spin disk when activated in one direction and rotating a shake cam against the upper half of the torso when activated in another direction, thereby achieving each portion of the dance.

18 Claims, 12 Drawing Sheets

DANCING TOY

CROSS REFERENCE TO RELATED APPLICATIONS

This application claims the benefit of U.S. provisional application Ser. No. 60/516,528, entitled "DANCING TOY" to Hoeting et al., filed 31 Oct. 2003.

FIELD OF THE INVENTION

The present invention relates, in general, to animated toys and more particularly to dolls and figures that are mechanically animated to simulate movements.

BACKGROUND OF THE INVENTION

Toy figures have long delighted children with various mechanical motions that mimic human gestures, walking and dancing. Generally, affordable animated toys are capable of only very simple movements due to a relatively small number of components and motors. Thus, animated toys capable of complex movements generally have a large number of components and motors and tend to be expensive.

Since the electric motor in an animated toy tends to be the most expensive component, it has generally been the practice for one motor to drive a number of actuating parts through various geared members. Some effects achieved in this way include a doll whose torso twists while the arms move. While initially entertaining, such animations tend to be rather repetitive and not capable of variations necessary for more complex motions with a number of sequential movements.

As an example of a complex motion, a dance that continues to be popular with both children and adults is the Hokey Pokey. Although relatively simple for even the smallest child to do, attempts to incorporate these movements into a toy have been only modestly successful. A toy designed to do the Hokey Pokey as its primary function would tend to be expensive due to the requirements for sequentially putting forward and shaking a leg, an arm, and a head as well as spinning the entire toy round. Consequently, such toys tend to simulate such movements in a nonrealistic way.

At the other extreme, robotic toys that include multiple, independently controlled motorized actuators have been known to include programming to do the Hokey Pokey dance. These toys tend to be multi-functional in order to justify their increased complexity and cost. Thus, the actuation of the various body parts still tends to be disappointing in that their movement is not optimized for the Hokey Pokey.

Consequently, a significant need exists for a toy that can effectively mimic the human movements of a complex dance, yet achieve this effect economically.

BRIEF SUMMARY OF THE INVENTION

The invention overcomes the above-noted and other deficiencies of the prior art by providing a toy that accomplishes a complex dance, such as the Hokey Pokey, with merely two electric motors, yet successfully spins about one foot and sequentially puts forward and shakes a hand, foot and head. Thus, an entertaining toy is achieved without being cost prohibitive.

In one aspect of the invention, a toy includes a torso including an upper half and a lower half pivotally coupled to rotate relative to one another about in a nonvertical axis defining a nonhorizontal plane. The upper portion includes a first arm aligned with a higher portion of the nonhorizontal plane and includes a second arm aligned with a lower portion of the horizontal plane. Thus, as the upper half rotates, the first arm appears to be put forward and down, imitating a common human arm movement. Moreover, a head part of the upper half also tends to tip forward or back in relation to the rotation, further suggesting putting a head forward and back.

In another aspect of the invention, incorporating a shaking mechanism into the toy causes the portion of the toy's body that is put forward to shake.

In yet another aspect of the invention, the toy is weighted and mechanized to spin about one foot to provide additional dance combinations.

These and other objects and advantages of the present invention shall be made apparent from the accompanying drawings and the description thereof.

DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
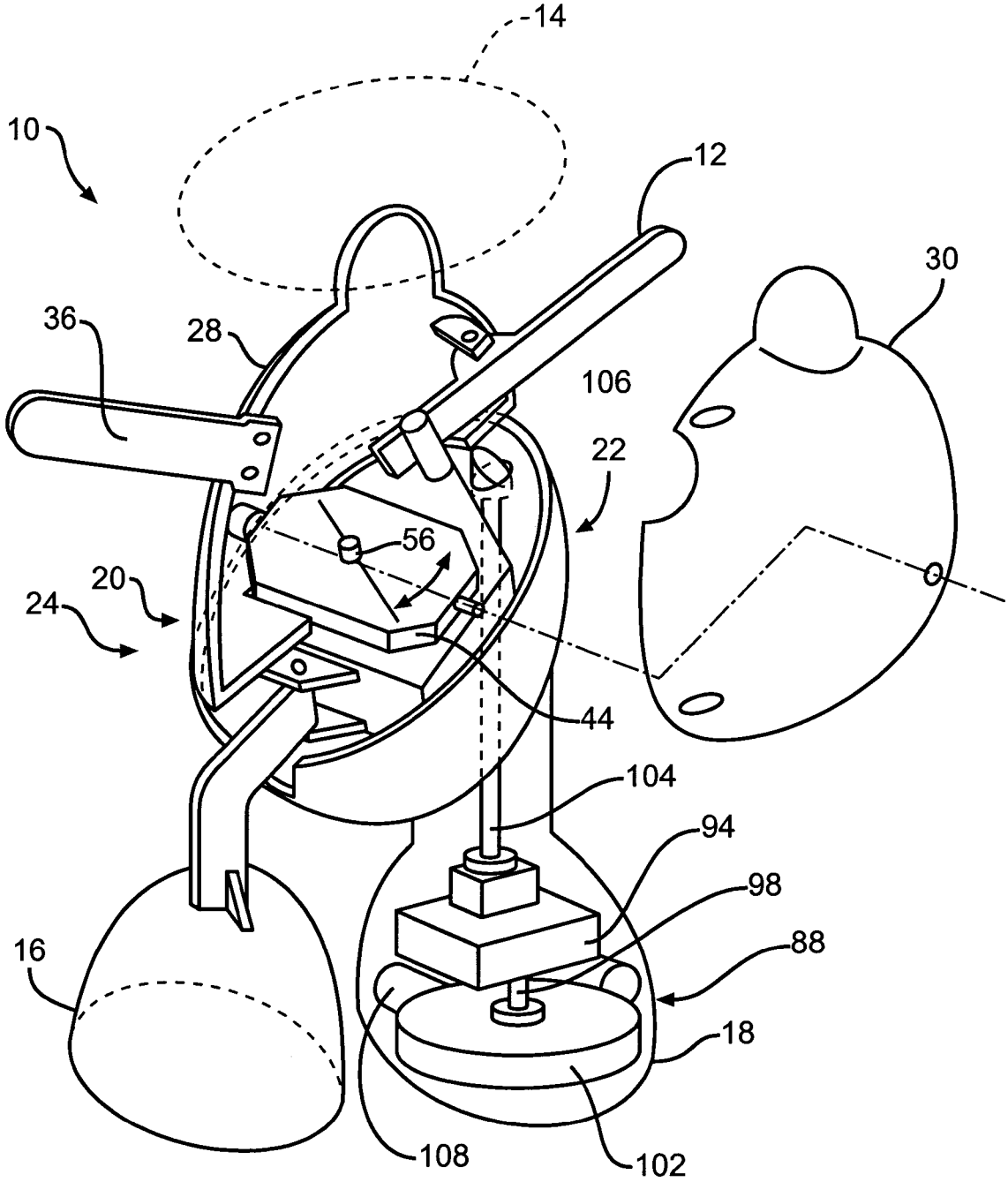
FIG. 1 is a perspective view of a toy partially exploded and with hidden portions shown in portion.
Figure 2:
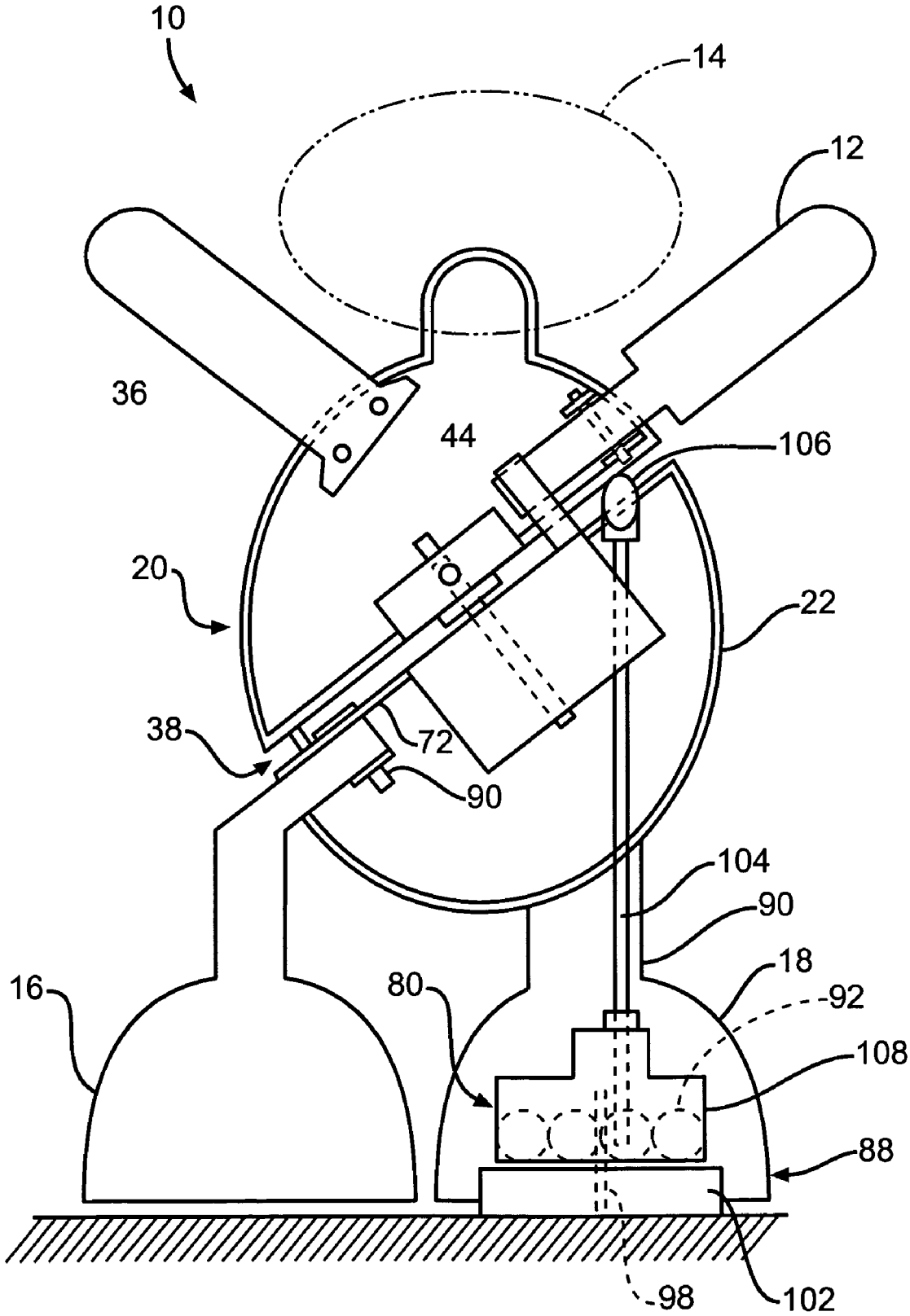
FIG. 2 is a front view in cross section of the toy of FIG. 1.
Figure 3:
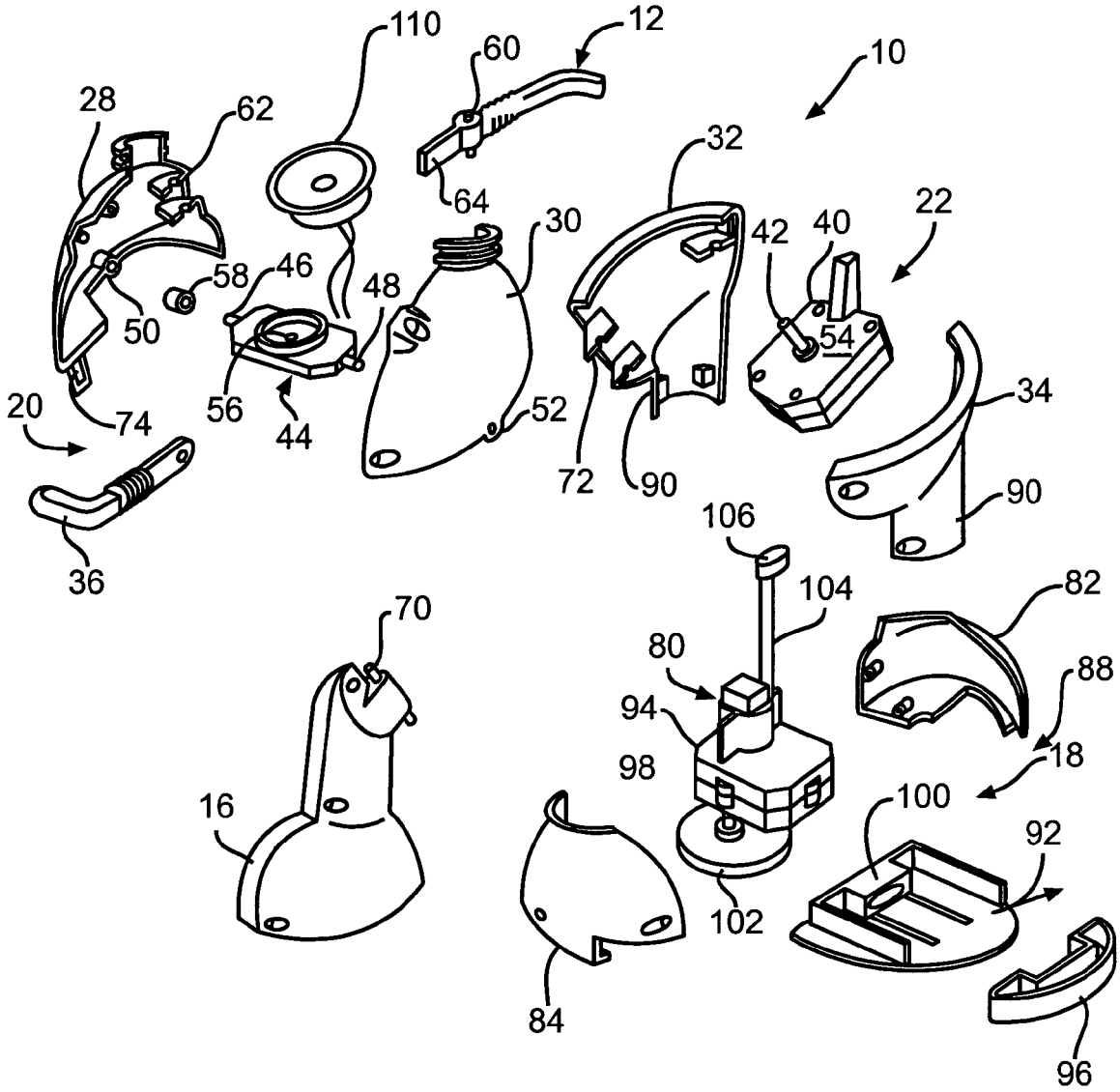
FIG. 3 is an exploded view of the toy of FIG. 1.

With reference to the drawings, wherein like components are given like reference numbers throughout the several views, in FIGS. 1-3 a toy 10 with only two motors dances the Hokey Pokey, including the steps of putting forward and shaking a left arm 12, a head 14, and a right foot 16, as well as spinning around about a left foot 18. Moreover, a non-horizontal pivoting relationship between an upper half 20 and a lower half 22 of a torso 24 of the toy 10 generates a more convincing movement by causing the upper portions to lean forward and back in a convincing manner.

The upper half 20 of the torso 24 has an upper back shell 28 that attaches to an upper front shell 30. Similarly, the lower half 22 of the torso 24 has a lower back shell 32 that attaches to a lower front shell 34. The torso 24 forms a generally ellipsoid shape bifurcated and spaced about a horizontal or non-horizontal plane having a highest point proximate to the left arm 12, a lowest point below a right arm 36 and level with respect to any front to back chords, forming a diagonal waist 38. (See FIG. 2.) The upper half 20 and lower half 22 of the torso 24 are spaced from one another at the diagonal waist 38 so that a shaking of the two halves 20, 22 with respect to each other may be induced, causing loosely coupled extremities (e.g., left arm 12, right foot 16 and head 14) to noticeably shake.

Swivel of the upper torso 20 is powered by a waist drive train assembly 40 engaged between the lower rear and front shells 32, 34 and projecting a waist drive shaft 42 approximately centered and perpendicular to the diagonal waist 38 to engage the upper half 20 of the torso 24. Advantageously, this engagement for rotation relative to the diagonal waist 38 allows pivoting between the upper and lower halves 20, 22 of the torso 24 with respect to a lateral axis. To this end, a torso pivot bracket 44 extends between the upper rear and front shells 28, 30 of the upper half 20 of the torso with a rear pin 46 aligned with a front pin 48 received respectively within a rear pivot hole 50 in the upper rear shell 28 and a front pivot hole 52 in the upper front shell 30. The torso pivot bracket 44 has sufficient lateral width to be stabilized against a top surface 54 of the waist drive train assembly 40 while engaging the waist drive shaft 42 through a center through hole 56. A mousetrap-style spring 58 is retained on the rear pin 46 and engages the torso pivot bracket 44 and the upper rear shell 28 and is preloaded to exert a pivoting force to tip the head 14 toward the left.

The right arm 36 is rigidly attached by being pinned between the upper rear and front shells 28, 30. The left arm 12 has a transverse pin 60 that pivotally engages to an arm receptacle 62 formed between the upper rear and front shells 28, 30. A range of pivoting movement of the left arm 12 is thereby defined about this transverse pin 60 as angularly constrained by an inward tab 64 of the left arm 12 that allows movement between physical limits inside of the upper half 20 of the torso 24. Rotation of the upper half 20 causes the left arm 12 to rotate somewhat farther in the direction of rotation due to tab 64 making contact with the stem protruding from gear box 40. The left arm 12 also has sufficient flexibility to vertically shake in response to lateral pivoting oscillation of the upper half 20 of the torso 24.

The right leg 16 has a transverse pin 70 that is engaged with a leg receptacle 72 formed between the lower rear and front shells 32, 34. The right foot 16 is allowed a forward pivoting movement with respect to the lower half 22 of the torso 24 when a kick tab 74 that extends downward on the right side of the upper rear shell 28 forwardly engages the backside of the right leg 16 as the upper half 20 of the torso 24 rotates the left arm 12 to the rear.

A spin/shake drive train assembly 80 is enclosed by an outer shell 82, an inner shell 84, and a foot bottom battery case 86 that form a left foot assembly 88 that rigidly attaches to a left leg portion 90 of the lower half 22 of the torso 24. A battery compartment 92 is formed by the foot bottom battery case 86 as covered overtop by a motorized gearbox 94 and is selectively closed in front by a battery door 96. A vertical spin shaft 98 extends downwardly from the motorized gearbox 94 through a rearwardly open slot 100 in the foot bottom battery case 86 to a spin disk 102 that is plastic or may be die cast of metal for weight and additional stability. The positioning and weighting of the other components of the toy 10 are such that the toy 10 may spin about the spin disk 102 as the motorized gearbox 94 turns the vertical spin shaft 98.

Upwardly projecting from the motorized gearbox 94 is a vertical shaker shaft 104 that extends up to a left portion of the diagonal waist 38 to present shake cam 106 to the upper half 20 of the torso 24. The shake cam 106 presents a face aligned with diagonal waist 38 at one portion of the rotation, allowing the upper half 20 to tip left under the urging of its weight and the spring force of the mousetrap-style spring 58. Further rotation of the shake cam 106 causes the upper half 20 to tip to the right. Thus, rapid rotation of the shake cam or any type of eccentric linkage 106 causes a left to right oscillatory shaking of the upper half 20 of the torso 24 that is transferred through to other portions of the toy 10.

A DC motor (not shown) within the motorized gearbox 94 is powered by batteries 108 (FIG. 2) to spin in one direction that is coupled to turn the vertical spin shaft 98, which causes a clockwise or counterclockwise rotation of the toy 10 as viewed from the top, while the vertical shaker shaft 104 is uncoupled. Energizing the DC motor in an opposite direction uncouples the vertical spin shaft 98 while turning the shake shaft 104 to cause shaking.

The toy 10 advantageously includes voice and music recordings to enhance interaction with the toy 10. An audio speaker 110 rests upon the torso pivot bracket 44 such that the voice of the toy 10 is directed within the upper half 20 out through a neck hole (FIG. 3) to emanate out of the head 14. Alternatively, an audio speaker can be mounted in the upper or lower torso or inside the head. Other controls may be incorporated such as a manual activation control and/or movement sensors so that the toy 10 may activate or deactivate as appropriate. For instance, a voice prompt to right the toy 10 may be given and the motorized gearbox 94 deactivated when the toy 10 is sensed as having fallen over.

Figure 5:
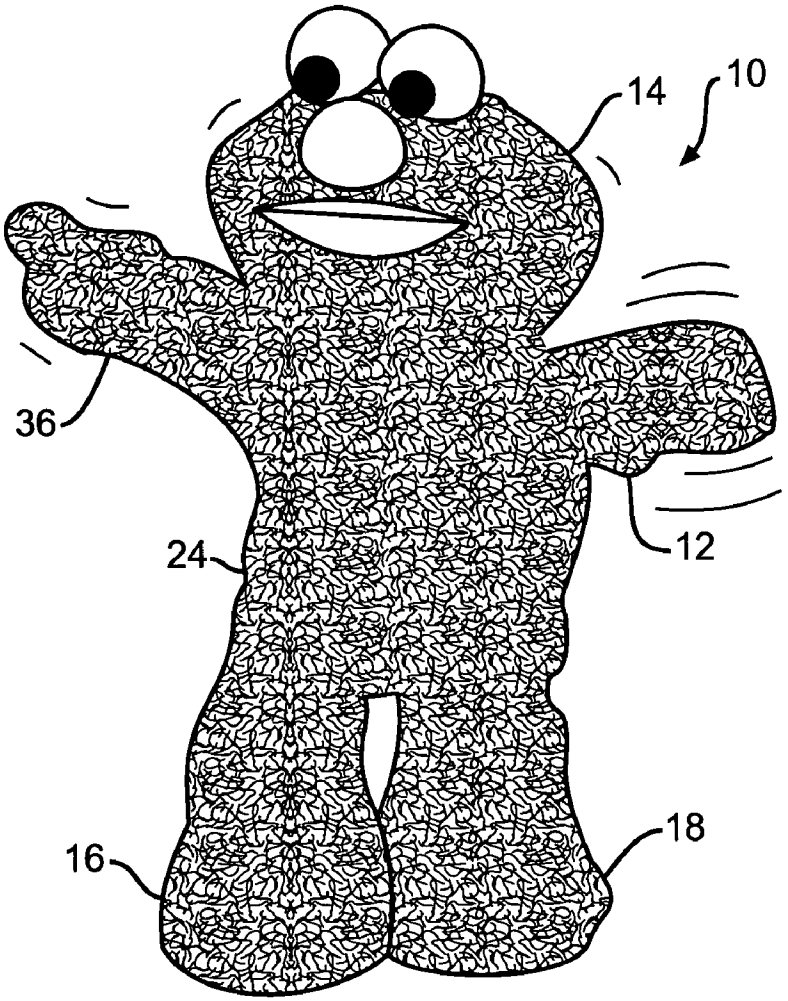
FIG. 5 is the toy of FIG. 4 after the upper half of the torso has been rotated forward and a shaking mechanism has been activated.
Figure 4:
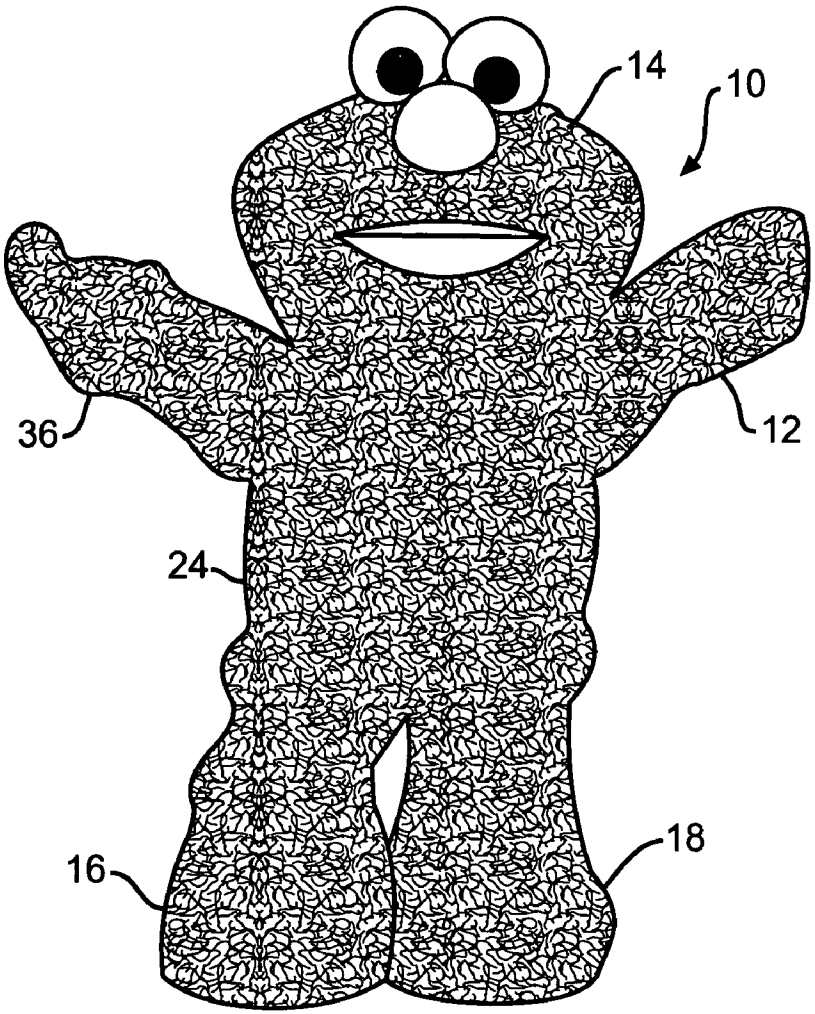
FIG. 4 is the toy of FIG. 1 further including a decorative covering and positioned in a start position.
Figure 7:
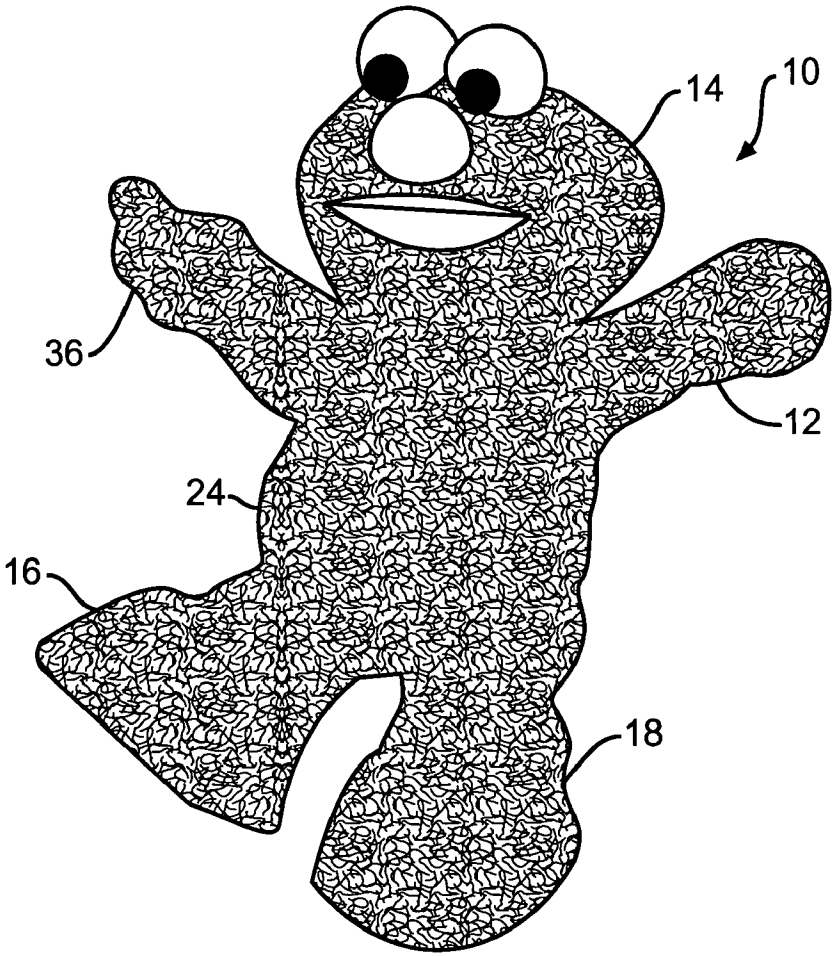
FIG. 7 is the toy of FIG. 4 after the upper half of the torso has been rotated backward, which has engaged and lifted the right foot.
Figure 6:
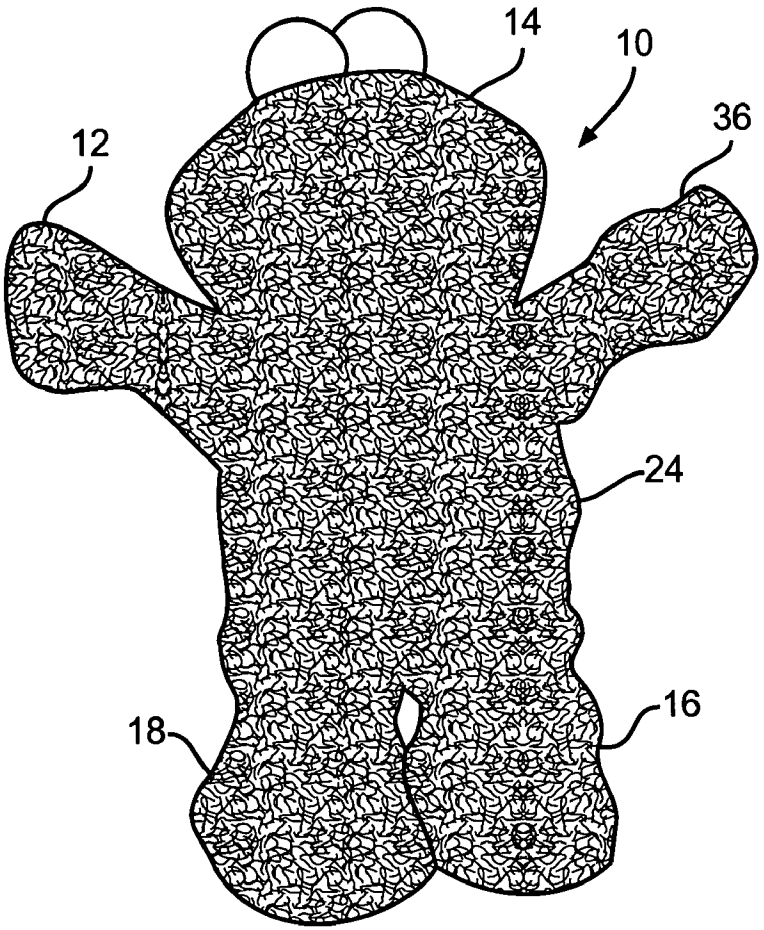
FIG. 6 is the toy of FIG. 4 after spinning half way around about the left foot.

In use, the toy 10 performs the Hokey Pokey dance as illustrated in FIGS. 4-7. In FIG. 4, the toy 10 is in an initial condition. In FIG. 5, the upper half 20 of the torso 24 is pivoted clockwise by activating the waist drive train assembly 40, as viewed from above, causing the left arm 12 to be put forward. Then, the shaker cam 106 is activated to induce a shaking of the left arm 12. In FIG. 6, The torso 24 has been returned to its initial unrotated condition and the toy 10 rotated about the vertical spin shaft 98 and spin disk 102. In FIG. 7, the toy 10 has returned after a 360 or a 720 degree spin. The torso 24 is rotated in an opposite sense, putting the left arm 12 back. As the torso 24 rotates in this direction, the right leg 16 is kicked out. When the shaker cam 106 is activated, the extended right leg 16 shakes.

Figure 8:
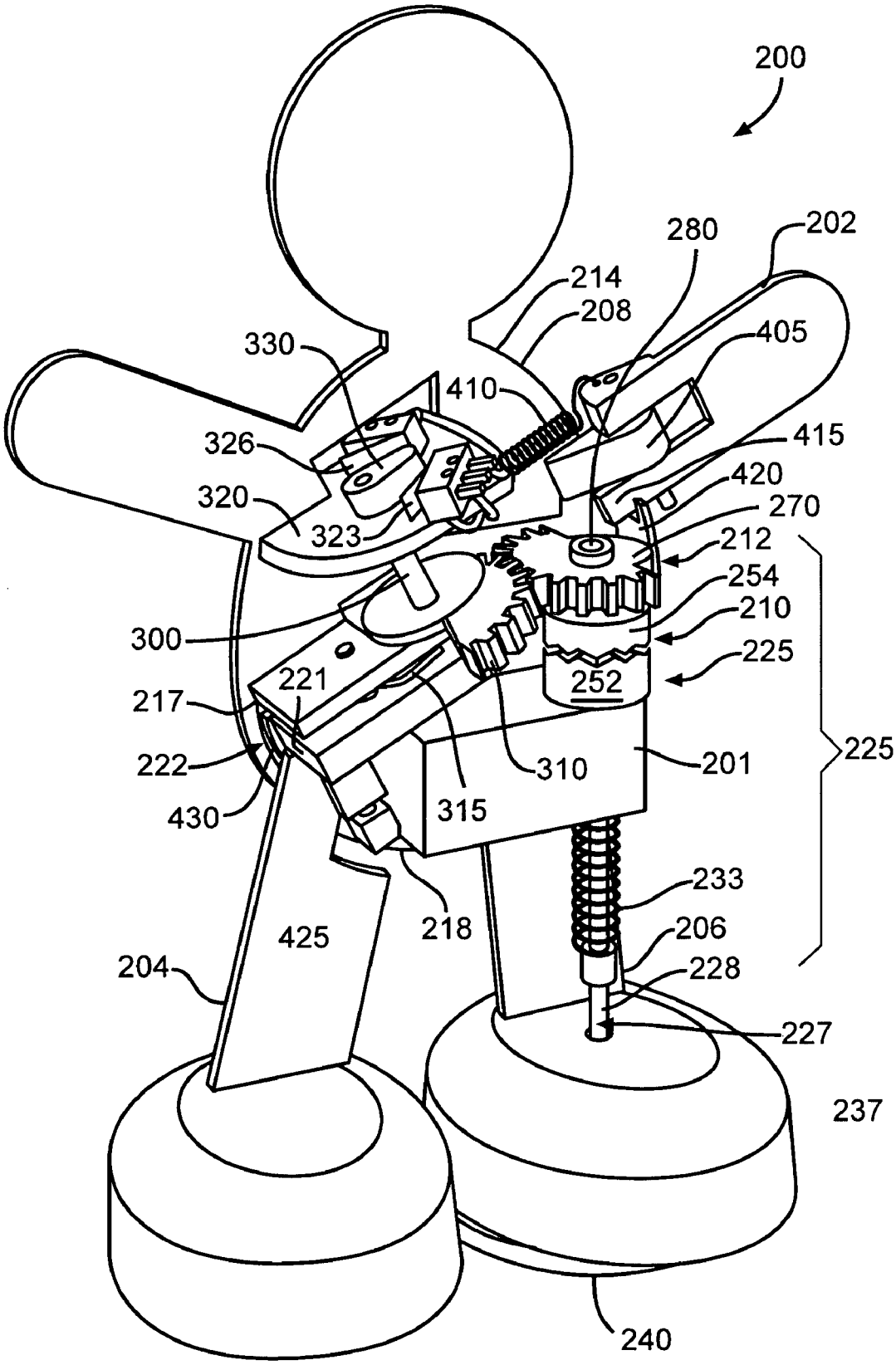
FIG. 8 is a front perspective view of a toy in a rest position with a motorized gearbox that achieves spinning, upper torso rotation and shaking with a single motor and a spin/shake drive assembly.

While the afore-described toy 10 advantageously performs movements that convincingly mimic human dancing, it is further desirable to reduce the number of motors from two to one in order to enhance economical manufacturing. To that end, in FIG. 8 a toy 200 with one motorized gear box 201 is capable of dance steps of putting forward and shaking a left arm 202 and a right leg 204, as well as spinning about a left leg 206. Moreover, a non-horizontal pivoting relationship between an upper half 208 and lower half 210 of a torso 212 of the toy 200 generates a convincing movement by causing the upper half 208 to lean forward and lean back.

The upper half 208 of the torso 212 has an upper back shell 214 that attaches to an upper front shell (not shown) about an upper inner frame 217. Similarly, the lower half 210 of the torso 212 has a lower back shell 218 that attaches to a lower front shell (not shown) about a lower inner frame 221. The torso 212 forms a generally ellipsoid shape bifurcated and spaced about a horizontal or non-horizontal plane having a highest point proximate to the left arm 202, a lowest point above the right leg 204 and level with respect to any front to back chords, forming a diagonal waist 222.

A spin/shake drive train assembly 225 secures the lower half 210 of the torso 212 and serves to spin the toy 200 about the left leg 206, swivel the upper half 208 of the torso 212 to put forward the left arm 202, shake the left arm 202, put forward the right leg 204 and shake the right leg 204. The spin/shake drive train assembly 225, shown partially disassembled in FIGS. 9-10, includes a vertical shaft 227. The vertical shaft 227 has a lower portion 228 extending downwardly from the motorized gearbox 201 through a compression spring 233, a lower shaft collar 235, and a left foot 237 of the left leg 206 to a spin disk 240. The positioning and weight of the other components of the toy 200 are such that the toy 200 may spin about the spin disk 240 as the motorized gearbox 201 turns about the vertical shaft 227. The lower shaft collar 235 is rigidly attached to the vertical shaft 227. The compression spring 233 is situated between the lower shaft collar 235 and the DC motor (not shown) within the motorized gearbox 201.

The vertical shaft 227 also includes an upper portion 242 (FIG. 9, 10) projecting upwardly from the motorized gearbox 201 and extending through a clutch assembly 250, an engagement disk 260, a lower body bevel gear 270 and an upper shaft collar 280. The clutch assembly 250 includes a lower clutch disk 252 and an upper clutch disk 254. The lower clutch disk 252 is rigidly attached to the DC motor within the motorized gearbox 201 and rotates concurrently with the motorized gearbox 201 about the vertical shaft 227. The upper clutch disk 254, the engagement disk 260 and lower body bevel gear 270 float freely about the vertical shaft 227. The upper shaft collar 280 is rigidly attached to the vertical shaft 227. The compression spring 237 provides a compression force, which compresses the DC motor, clutch assembly 250, engagement disk 260 and lower body bevel gear 270 together against the upper shaft collar 280.

The engagement disk 260 includes a downwardly projecting engagement pin 263 and an upwardly projecting engagement pin 267. The upper clutch disk 254 includes a circumferential groove 255 in its top surface 256 for engagement with the downwardly projecting engagement pin 263 of the engagement disk 260. The circumferential groove 255 includes a first extreme portion 257 (most clockwise from top view) and a second extreme portion 258 (most counterclockwise from top view). The arc measure of the circumferential groove 255 may be in the range of about 45° to nearly 360°. In the illustrative version, arc measure is just over a half rotation that, given the diameter of the downwardly projecting engagement pin 263, allows for at least a half rotation relatively between the engagement disk 260 and upper clutch disk 254.

Figure 10:
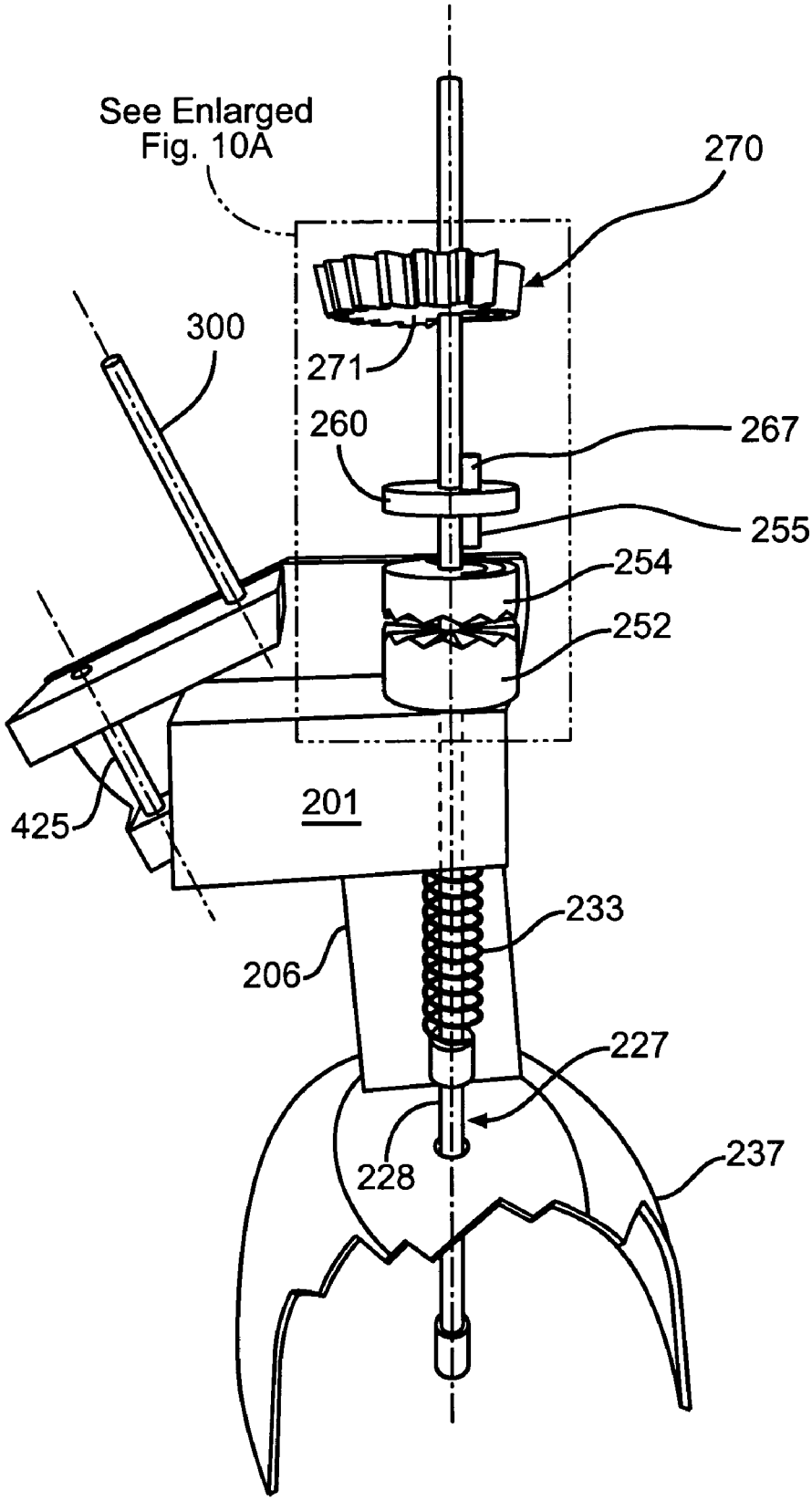
FIG. 10 is a perspective view of the disassembled spin/shake drive assembly of FIG. 9 from a slightly lower vantage point.
Figure 10A:
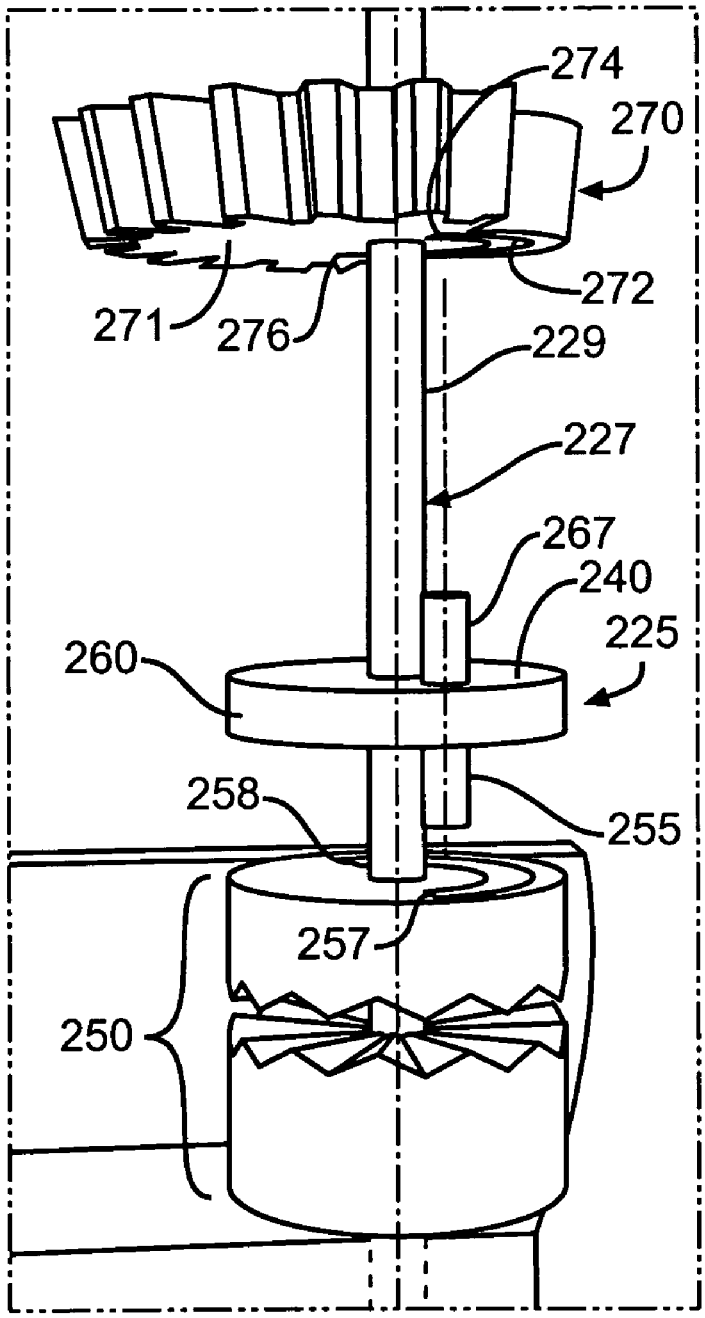
FIG. 10A is a perspective detail view of upper portions of the spin/shake drive assembly of FIG. 8.

The lower body bevel gear 270 includes an arc recess 272 (FIG. 10-10A) in its lower face 271 for engagement with the upwardly projecting engagement pin 267 of the engagement disk 260. The arc recess 272 includes a first end 274 (most clockwise with respect to a top view) and a second end 276 (most counterclockwise with respect to a top view. The arc measure of the arc recess 272 may be in the range of about 45° to nearly 360°. Combining this rotational range of movement with the circumferential groove 255 may achieve unimpeded rotation of about 90 to 720°. In the illustrative version, arc measure is just over a half rotation that, given the diameter of the upwardly projecting engagement pin 267, allows for at least a half rotation relatively between the engagement disk 260 and the lower body bevel gear 270.

Figure 9:
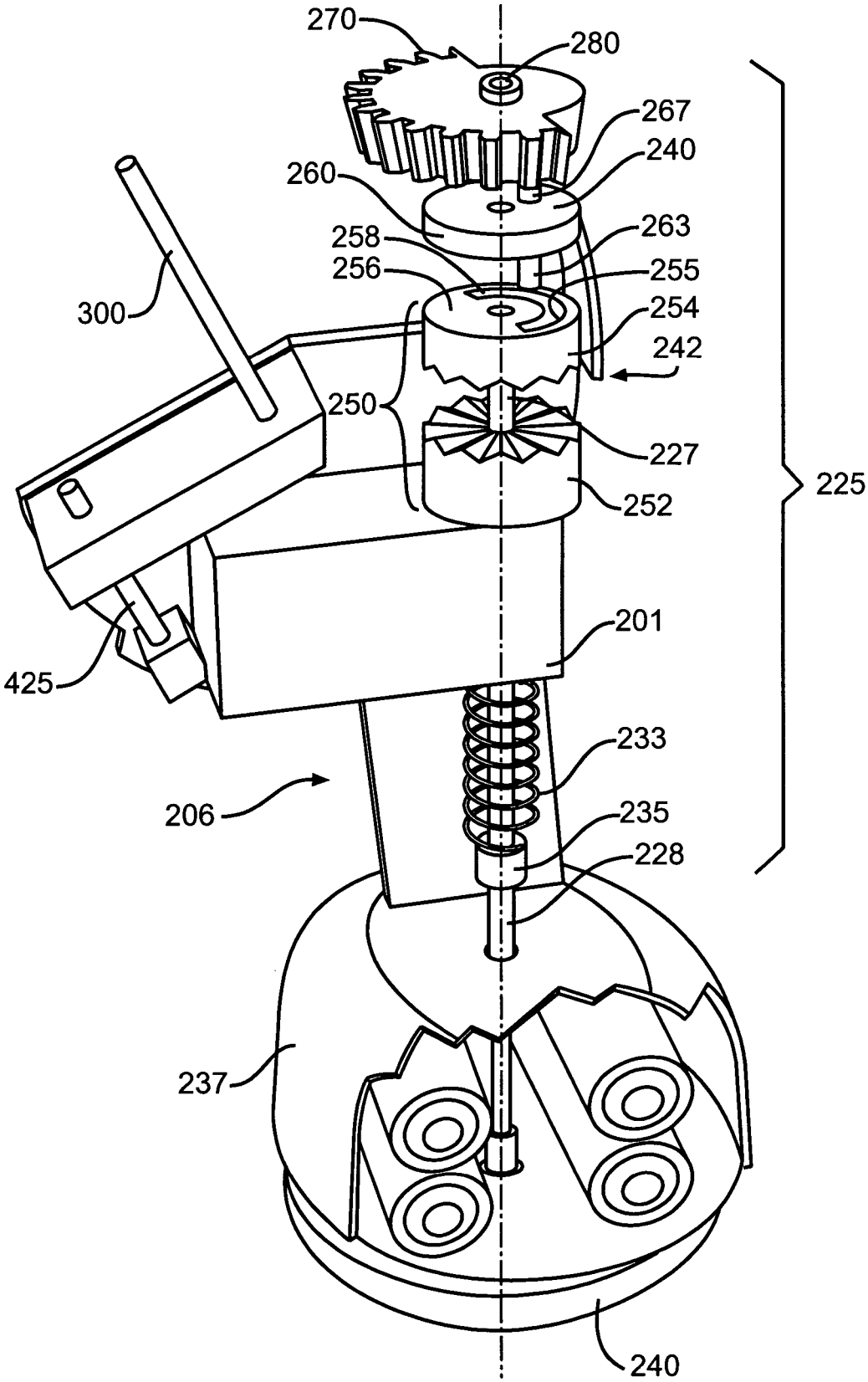
FIG. 9 is a perspective view of the disassembled, partially cut-way view of the spin/shake drive assembly of the toy of FIG. 9.

The DC motor within the motorized gearbox 201 may be powered by batteries, which may be stored within the left foot 237 (FIG. 9). Via the DC motor, the motorized gearbox 201 rotates about the vertical shaft 227 either clockwise or counterclockwise, as further discussed below. Initially, the lower clutch disk 252 and the upper clutch disk 254 rotate together as a single unit. The downwardly projecting engagement pin 263 of the engagement disk 260 floats freely within the circumferential groove 255 of the upper clutch disk 254. With continued rotation in one direction, eventually, the first extreme portion 257 or second extreme portion 258 of the circumferential groove 255 will be rotated into the downwardly projecting engagement pin 263, and any further rotation of an extreme portion 257, 258 into the downwardly projecting engagement pin 263 will communicate the rotation of the upper clutch disk 254 to the engagement disk 260, thereby causing the engagement disk 260 to rotate concurrently with the upper clutch disk 254.

At the initial rotation of the engagement disk 260, the upwardly projecting engagement pin 267 floats freely within the arc recess 272 of the lower body bevel gear 270. With continued rotation in a direction, eventually, the upwardly projecting engagement pin 267 will be rotated into the first end 274 or second end 276 of the arc recess 272, and any further rotation of the upwardly projecting engagement pin 267 into the end 274, 276 will communicate the rotation of the engagement disk 260 to the lower body bevel gear 270, thereby causing the lower body bevel gear 270 to rotate concurrently with the engagement disk 260, clutch assembly 250 and motorized gearbox 201.

The upper half 208 of the torso 212 pivots about an upper body axle 300 extending upwardly from the lower inner frame 221 and aligned perpendicularly to the non-horizontal (diagonal) waist between the body halves. The upper body axle 300 extends through an upper body spur gear 310 and a switch plate 320, both of which are rigidly secured to, or integral parts of, the upper inner frame 217. The lower body bevel gear 270 engages the upper body spur gear 310 and rotation of the lower body bevel gear 270 communicates rotation to the upper body spur gear 310 thereby pivoting the upper half 208 of the torso 212 about the upper body axle 300. Clockwise rotation of the motorized gearbox 201 about the vertical shaft 227 results in a counterclockwise, or backward, rotation of the upper half 208 of the torso 212 about the upper body axle 300. Counterclockwise rotation of the motorized gearbox 201 about the vertical shaft 227 results in a clockwise, or forward, rotation of the upper half 208 of the torso 212 about the upper body axle 300. Additionally, a torsion spring 315 (FIG. 8) may be situated between the upper half 208 and lower half 210 of the torso 212 such that when the lower body bevel gear 270 is not communicating rotation to the upper body spur gear 310, the torsion spring 315 positions and/or maintains the upper half 208 of the torso 212 in an upright position.

The upper body axle 300 includes a cam 330 rigidly attached to the upper body axle 300 above the switch plate 320. The switch plate 320 has an arm-in switch 323 and a leg-in switch 326. As the upper half 208 of the torso 212 rotates about the upper body axle 300, the arm-in switch 323 or leg-in switch 326 are rotated towards the cam 330 to eventually contact the cam 330.

Initially, contact between the cam 330 and either switch 323, 326 is used by control circuitry (not shown) to determine when the toy 200 has reach its full movement in one direction prior to clutch slippage. As discussed below, the control circuitry may remove power to the DC motor, thereby ceasing communicated rotation of the upper half 208 of the torso 212 about the upper body axle 300. Alternatively, the circuit may continue to actuate the DC motor in the same rotational direction whereupon the lower body bevel gear 270 reaches its stop against the upper body spur gear 310, causing the lower clutch plate 252 to slip against the upper clutch plate 254, their radial ridges surfaces creating a shake against compression spring 233. Alternatively or in addition, contact between the cam 330 and either switch 323, 326 also serves to physically impede further rotation to initiate the shaking. This shaking of the toy 200 may occur when either the left arm 202 or right leg 204 has been placed forward, or "in" for the purposes of the Hokey Pokey dance. The extension of these respective parts enhances the shake at their extremities, thereby creating an impression that the left arm 202 or right leg 204 are being shook.

Figure 11:
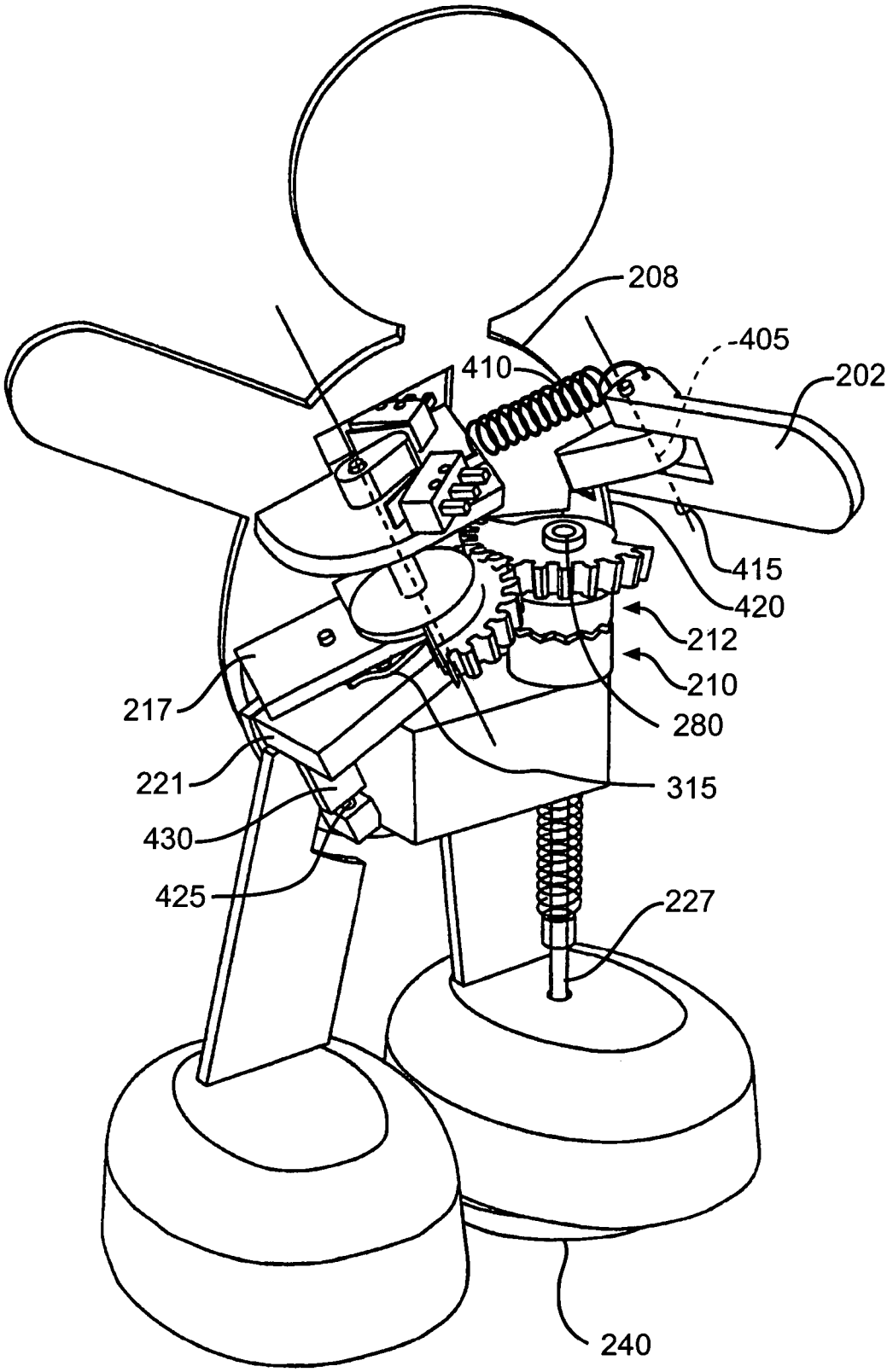
FIG. 11 is a perspective view of the toy of FIG. 8 in an Arm-In Position.

The left arm 202 pivotally engages an arm receptacle 405 of the upper inner frame 217. The lower inner frame 221 includes a stop 420 to engage a tab 415 of the left arm 202. When the upper half 208 of the torso 212 is rotated clockwise relative to the lower half 210 as in FIG. 11, or forward, the tab 415 of the left arm 202 will eventually engage the stop 420 thereby pivoting the left arm 202 to a forward, or "arm in", position. An extension spring 410 may also secure the left arm 202 to the upper inner frame 217 and maintain the left arm 202 in substantially the same plane as the upper inner frame 217 when the toy 200 is in its normal upright position, as well as, pivot the left arm 202 counterclockwise thereby planarly realigning the left arm 202 with the upper inner frame 217 when the tab 415 and stop 420 become disengaged.

Figure 12:
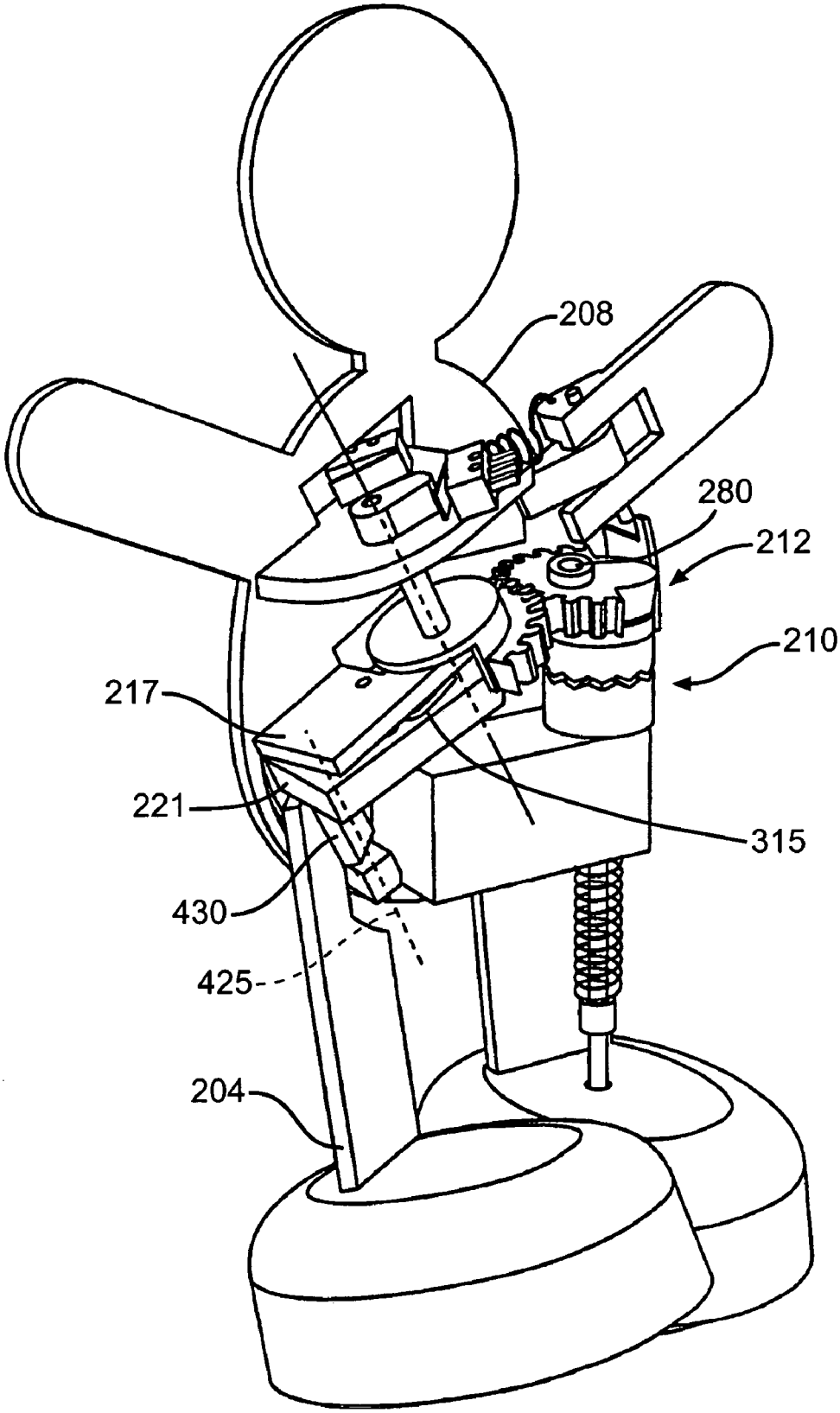
FIG. 12 is a perspective view of the toy of FIG. 8 in a Leg-In Position.

The right leg 204 pivotally engages the lower inner frame 221 at a leg axle 425. The upper inner frame 217 includes a prong 430 to engage the right leg 204. When the upper half 208 of the torso 212 is rotated counterclockwise relative to the lower half 210 as in FIG. 12, or backward, the prong 430 eventually engages the right leg 204 thereby pivoting the right leg 204 to a forward or "leg in" position. The mass of the right leg 204 may be distributed such that when the prong 430 and right leg 204 are not engaged, the right leg 204 rests in substantially the same plane as lower inner frame 221.

Figure 13:
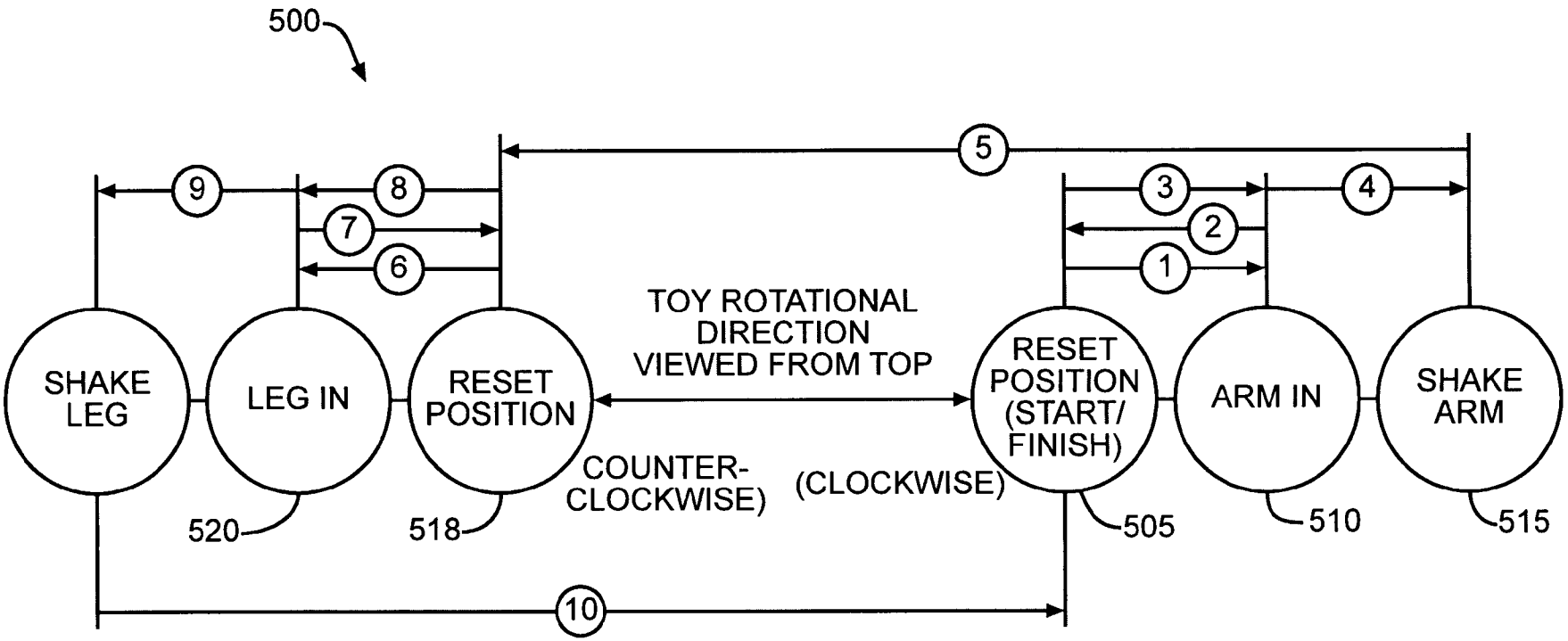
FIG. 13 is a timing diagram or flow chart of the sequence of operations of the toy of FIG. 8.

In use, with reference to FIG. 13, the coordinated movement of the toy 200 may be best understood through the flow chart 500 of an exemplary embodiment of a logic, which may be employed via control circuitry, together with the above description and FIGS. 8 through 12. The upper half 208 of the torso 212 of the toy 200 begins in a REST POSITION (START/FINISH) 505. The cam 330 has made initial contact with the Arm-In Switch 323. In STEP 1, the toy 200 first moves the upper half 208 of the torso 210 from REST POSITION (START/FINISH) 505 to an ARM-IN POSITION 510, defined as the left arm 202 pivoted forward and the arm in switch 323 and cam 330 into full travel contact, as follows. Power to the DC motor initiates clockwise rotation of the toy 200 about the spin disk 240. As the toy 200 spins clockwise, the clutch assembly 250 spins relatively counterclockwise and the downwardly projecting pin 263 of the engagement disk 260 is eventually engaged at the first extreme portion 257 of the circumferential groove 255 of the upper clutch disk 254. With the downwardly projecting pin 263 engaged at the first extreme portion 257, the engagement disk 260 begins to rotate concurrently with the clutch assembly 250, and, eventually, the upwardly projecting engagement pin 267 engages the first end 274 of the arc recess 272 of the lower body bevel gear 270, which communicates further clockwise rotation to the lower body bevel gear 270.

Counterclockwise rotation of the lower body bevel gear 270 causes clockwise rotation of the upper body spur gear 310, resulting in clockwise or forward rotation of the upper half 208 of the torso 212 about the upper body axle 300. As the upper half 208 of the torso 212 is rotated clockwise, the tab 415 of the left arm 202 eventually engages the stop 420 of the lower inner frame 221, thereby rotating the left arm 202 forward. Also, simultaneous with or shortly after the left arm 202 is rotated forward, the arm in switch 323 and cam 330 make contact.

Once ARM-IN POSITION 510 is achieved, in STEP 2, the upper half 208 of the torso 212 of the toy 200 returns to REST POSITION (START/FINISH) 505 as follows. Contact between the arm in switch 323 and cam 330 sends a signal to the control circuitry, which cuts power to the DC motor, ceasing all rotation due to the DC motor, which, in turn, allows the torsion spring 315 to rotate the upper half 208 of the torso 212 counterclockwise about the upper body axle 300 returning the upper half 208 to REST POSITION (START/FINISH) 505.

In STEP 3, once the upper half has been returned to REST POSITION (START/FINISH) 505, the upper half 208 is again moved to ARM-IN POSITION 510 as described above. In STEP 4, at the appropriate point in a recorded musical song, the control circuitry then drives the DC motor further and the toy 200 proceeds to SHAKE ARM POSITION 515 as follows. With the DC motor attempting further clockwise rotation of the toy 200 with the arm in switch 323 in contact with the cam 330, the arm in switch 323 acts as a physical stop to such further rotation resulting in the lower clutch disk 252 slipping against the upper clutch disk 254 thereby shaking the toy 200.

In STEP 5, once the toy 200 has shook for a predetermined amount of time, the DC motor is rotated in the opposite direction to cause counterclockwise direction of the toy 10 for about a full rotation, resetting the spin/shake drive train assembly 225 from one extreme of its travel to the other. Thus, at REST POSITION 518, which is slightly more counterclockwise than the REST POSITION (START/FINISH) 505, the cam 300 makes initial contact with Leg-In switch 326.

In STEP 6, the toy 200 moves the upper half 208 to LEG-IN POSITION 520, defined as the right leg 204 pivoted forward and the leg in switch 326 and cam 330 in contact, as follows. Power to the DC motor initiates counterclockwise rotation of the toy 200 about the spin disk 240. As the toy 200 spins counterclockwise, the clutch assembly 250 spins relatively clockwise and the downwardly projecting pin 263 of the engagement disk 260 is eventually engaged at the second extreme portion 258 of the circumferential groove 255 of the upper clutch disk 254. With the downwardly projecting pin 263 engaged at the second extreme portion 258, the engagement disk 260 begins to rotate concurrently with the clutch assembly 250, and, eventually, the upwardly projecting engagement pin 267 engages the second end 276 of the arc recess 272 of the lower body bevel gear 270, which communicates further clockwise rotation to the lower body bevel gear 270.

Clockwise rotation of the lower body bevel gear 270 causes counterclockwise rotation of the upper body spur gear 310 resulting in counterclockwise, or backward, rotation of the upper half 208 of the torso 212 about the upper body axle 300. As the upper half 208 of the torso 212 is rotated counterclockwise, the prong 430 of the upper inner frame 217 eventually engages the right leg 204 thereby rotating the right leg 204 forward. Also, simultaneous with, or shortly after the right leg 204 is rotated forward, the leg in switch 326 makes full travel contact.

Once LEG-IN POSITION 520 is achieved, in STEP 7, the upper half 208 of the torso 212 of the toy 200 returns to REST POSITION 518 as follows. The DC motor is rotated to cause the toy 10 to rotate clockwise. The torsion spring 315 rotates the upper half 208 of the torso 212 clockwise about the upper body axle 300 returning the upper half 208 to REST POSITION 518. As cam 330 releases from Leg-In switch 326, the control circuitry knows that the REST POSITION 318 has been reached.

In STEP 8, the upper half 208 is again moved from REST POSITION 518 to LEG-IN POSITION 520 as described above until the Leg-In switch 326 is to full travel. At the appropriate point in the musical song, in STEP 9, the DC motor attempts to drive the spin/shake drive train assembly further clockwise (i.e., toy 200 counterclockwise) to LEG SHAKE POSITION 525. Being prevented from doing so, the clutch disks 252, 254 slip and cause shaking. Thereafter, the control circuitry initiates clockwise rotation of the toy 200 back to the REST POSITION (START/FINISH) 505 wherein initial contract is made with the Arm-In switch 323.

The toy 200 may include a mechanism for playing voice and music recordings, which may also be controlled via the control circuitry such that the recordings are played in coordination with the movement of the toy 200. Additionally, the toy 200 may be powered by AC. Also, the toy 200 may also include a radio or remote controls to control all or part of the movement.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art. For example, although the Hokey Pokey dance is enabled in the illustrative version, other dances and human mimicry may be achieved consistent with aspects of the invention.

What is claimed is:

1. A toy, comprising:

a torso including an upper portion and a lower portion separated by a canted plane, wherein each portion of the torso has an anterior region, a posterior region, a first lateral side, and a second lateral side;

an axle extending generally upwardly at an acute angle to vertical between the upper and lower portions of the torso, the axle defining a generally upward and non-vertical axis perpendicular to the canted plane separating the upper and lower portions of the torso, wherein the axle is oriented such that a first end of the axle points toward the first lateral side of the upper portion of the torso, and a second end of the axle points toward the second lateral side of the lower portion of the torso;

an appendage attached to the upper portion of the torso, proximate to a lateral portion of the canted plane, wherein the appendage extends upwardly and outwardly from the second lateral side of the upper portion of the torso; and an actuator operably connected to the axle and to a selected one of the upper portion and the lower portion of the torso to cause rotation of the upper portion to selectively position the appendage fore and aft, relative to the lower portion of the torso, wherein the actuator comprises a rotating member.

2. The toy of claim 1, wherein the upper portion further comprises:

a rocking member pivotally coupling the upper portion to the lower portion of the torso; and an oscillatory member operably coupled between the upper and lower portions to induce a shaking in the upper portion.

3. The toy of claim 1, further comprising a second appendage, wherein the second appendage comprises a kicking leg pivotally connected to the lower portion of the torso and an actuating member connected to the upper portion and positioned to move the kicking leg relative to the lower portion of the torso when the upper portion of the torso pivots relative to the lower portion of the torso.

4. The toy of claim 1, wherein the appendage comprises an arm pivotally connected to the upper portion of the torso and an arm pivot mechanism responsive to relative rotation between the upper and lower portions of the torso to rotate the arm relative to the upper portion of the torso.

5. The toy of claim 1, further comprising an audio player operably configured to play a stored audio signal.

6. The toy of claim 1, further comprising:

a stationary member supporting the lower portion of the torso; and a spinning device operably coupled between the stationary member and the lower torso to rotate the torso.

7. The toy of claim 6, further comprising:

a rocking member pivotally coupling the upper portion to the lower portion of the torso;

an oscillatory member operably coupled between the upper and lower portions to induce a shaking in the upper portion;

an electric motor operably configured to selectively operate in one of two rotational directions; and a gear box responsive to the electric motor to couple one of the two rotational direction operations to the oscillatory member and the second of the two rotational direction operations to the spinning device.

8. The toy of claim 6, further comprising a spin/shake drive assembly operably configured to rotate the lower portion of the torso and the upper portion of the torso together in a selected one or two directions about the stationary member to a rest position, further operably configured to rotate the lower torso relative to the upper portion of the torso to an appendage out position, and yet further operably configured to rotate further in the selected direction to cause a slip clutch to slip to cause shaking.

9. A toy, comprising:

a torso including an upper portion and a lower portion pivotally coupled to rotate about a canted plane relative to one another, wherein each portion of the torso has an anterior region, a posterior region, a first lateral side, and a second lateral side, wherein an axis extending perpendicularly from the canted plane intersects the first lateral side of the upper portion of the torso and the second lateral side of the lower portion of the torso;

an arm extending from the second lateral side of the upper portion of the torso;

an actuator operably connected to the torso to cause pivotal rotation of the upper portion relative to the lower portion, to position the arm, wherein the actuator comprises a rotating member, wherein the actuator is operable to cause the arm to move from a lateral orientation to an anterior orientation, relative to the lower portion of the torso;

a stationary member supporting the lower portion of the torso upon a support surface; and a spinning device operably coupled between the stationary member and the lower torso to horizontally rotate the torso about the stationary member, independently of the actuator causing the arm to move from a lateral orientation to an anterior orientation.

10. The toy of claim 9, wherein the spinning device further comprises a motor connected to a gearbox that is operatively configured to respond to first rotational direction of the motor to spin the torso about the stationary member and to respond to an opposite second rotational direction of the motor to rotate a shake shaft that vibratingly couples to the upper portion of the torso.

11. The toy of claim 9, further comprising a second motor operatively coupled between the upper and lower portions of the torso to effect relative rotation therebetween.

12. The toy of claim 9, wherein an appendage is pivotally coupled to the torso and responsive to a relative rotation between the upper and lower portions to effect rotation about its pivotal coupling.

13. The toy of claim 9, wherein the pivotal coupling between the upper and lower portions of the torso comprises a diagonal pivot laterally bisecting the torso in a canted plane.

14. A toy, comprising:

a torso comprising an upper portion pivotally connected to a lower portion, wherein each portion of the torso has an anterior region, a posterior region, a first lateral side, and a second lateral side;

a stationary member positionable upon a support surface;

an appendage extending from the first lateral side of the upper portion of the torso or the lower portion of the torso;

a spin/shake drive assembly operably configured to horizontally rotate the lower portion and upper portion of the torso together in a selected one or two directions about the stationary member to a rest position, to further rotate in the selected direction to rotate the upper torso relative to the lower torso to an appendage out position while the lower portion of the torso is at the rest position, and to cause a slip clutch to slip with further commanded rotation to cause shaking, wherein the appendage is moved to extend from a lateral position to an anterior position, relative to the lower portion of the torso, in the appendage out position.

15. The toy of claim 14, wherein the pivotal coupling between the upper and lower portions of the torso comprises a diagonal pivot laterally bisecting the torso in a canted plane.

16. The toy of claim 14, wherein an appendage is pivotally coupled to the torso and responsive to a relative rotation between the upper and lower portions to effect rotation about its pivotal coupling.

17. The toy of claim 16, wherein the appendage comprises an arm.

18. The toy of claim 16, wherein the appendage comprises a leg.

* * * * *